United States Patent [19]

Arad et al.

[11] Patent Number: 4,556,397

[45] Date of Patent: Dec. 3, 1985

[54] TOY VEHICLE

[76] Inventors: Avi Arad, #6 Minute Man Hill, Westport, Conn. 06880; Melvin R. Kennedy, #2 Fifth Ave., New York, N.Y. 10011; Dietmar Nagel, 147 South Rd., Chester, N.J. 07930

[21] Appl. No.: 678,673

[22] Filed: Dec. 6, 1984

[51] Int. Cl.[4] ..... A63H 17/00

[52] U.S. Cl. ..... 446/436; 446/437

[58] Field of Search ..... 446/457, 460, 462, 463, 446/466, 437, 436, 465, 431

[56] References Cited

U.S. PATENT DOCUMENTS

| | | | |
|---|---|---|---|
| 2,168,788 | 8/1939 | Biller | 446/436 |
| 3,574,267 | 4/1971 | Schorsch | 446/431 |
| 3,984,939 | 10/1976 | Wolgamot et al. | 446/437 X |

FOREIGN PATENT DOCUMENTS

| | | | |
|---|---|---|---|
| 2124094 | 2/1984 | United Kingdom | 446/457 |

*Primary Examiner*—Mickey Yu

*Attorney, Agent, or Firm*—Kenyon and Kenyon

[57] ABSTRACT

A toy vehicle utilizes a depressible stunt wheel to elevate the vehicle to perform various tricks. An adjustable nob on the vehicle's chassis permits a user to preselect the distance the vehicle travels before the stunt wheel is automatically depressed. A shaft positionable in various slots in the vehicle's roof permits a user to preselect and fix the angle of the stunt wheel, during depression, relative to the traveling wheel of the vehicle, and the extent to which the stunt wheel is depressed below the chassis.

16 Claims, 11 Drawing Figures

TOY VEHICLE

BACKGROUND OF THE INVENTION

This invention relates to toy vehicles, and more particularly, to toy vehicles having retractable wheels which can be employed to cause the vehicle to perform a stunt.

Lohr, U.S. Pat. No. 2,124,302 discloses a wind-up toy car that can run on any of a plurality of complex paths. A fifth cross wheel can be lowered periodically into engagement with the playing surface by the drive of the motor. The angle through which the vehicle is turned when the cross wheel is engaged can be varied by fixing the cross wheel in any of a plurality of angles or steering positions.

Wolgamut, U.S. Pat. No. 3,984,939, discloses a toy car having a fifth wheel that engages the playing surface and thereby induces the toy to skid in response to the removal from the car's roof of a toy figure. The fifth, skid-inducing wheel is positionable in a plurality of angular orientations. A lever that extends through the windshield can be adjusted to override the wheel actuator and to prevent the fifth wheel from engaging the ground.

Stohrer, U.S. Pat. No. 3,481,072, discloses a toy vehicle having two cams. One cam controls a steering wheel, mounted on the forward end of the body, and the second cam engages the locomotion wheel to move the vehicle forward or reverse, or to remain stationary. The cams are made up of sectors of varying radii. By arranging the cam sectors as desired, the user can determine the path of the vehicle.

Swenson, U.S. Pat. No. 2,421,041, discloses a toy car capable of traversing any selected one of a plurality of paths determined by the contours of a pair of cams selected from a plurality of pairs. In each pair, one cam determines the angular orientation of the fifth steering wheel over time, and the second cam determines the pattern of forward and backward motion and of stationary periods of the toy. Cam pairs are selected by moving a handle, projecting from slots.

Carl, U.S. Pat. No. 2,070,465, discloses a toy tank provided with a control disk that rotates in synchrony with the driving wheel. Numbers marked around the circumference of the control disk indicate the distance travelled by the vehicle. Pins inserted along the periphery of the disk on either the right or left side of the disk engage brakes on the right or left wheel, respectively, causing the vehicle to turn when it has travelled the distance marked on the control wheel where a pin is inserted.

De Fillipis, U.S. Pat. No. 1,756,539, discloses a toy vehicle provided with a horizontal disk that rotates in synchrony with the wheels. On the disk is a series of concentric grooves having different patterns. The user selects a groove by inserting in that groove a pin which is rigidly attached to a lever that in turn is connected to the front axle. The pattern of the selected groove on the horizontal disk determines the path travelled by the car.

SUMMARY OF THE INVENTION

In general, the invention features a toy vehicle having a chassis, a traveling wheel mounted on the chassis and supporting the vehicle, a stunt wheel supported by the chassis and depressible to contact a running surface and to elevate the vehicle, and means for continuously depressing the stunt wheel in contact with the running surface and elevating the vehicle after the vehicle has traveled a distance preselected from a predetermined range.

In preferred embodiments: the user preselects an extent of depression of the stunt wheel; the user preselects the angle of the stunt wheel relative to the traveling wheel; the means for depressing the stunt wheel includes means for lowering the stunt wheel upon activation, and means coupled to the traveling wheel for activating the lowering means after a rotation of the traveling wheel preselected from a predetermined range; the means for preselecting the angle of the stunt wheel includes a shaft that is pivotally connected to the stunt wheel and that extends through an opening in the body of the vehicle; a shoulder along the length of the shaft engages with at least one of the slots that make up the opening and thereby limits the extent of depression of the stunt wheel; the stunt wheel lowering means includes a carriage pivotally mounted to the chassis and coupled to the stunt wheel, an arm pivotally mounted on the chassis and having a projection that is aligned to engage a notch in the carriage, and a spring coupled between the carriage and the arm that urges the carriage downward and the arm against the carriage; or the means for activating the lowering means includes a member that rotates in response to rotation of the traveling wheel having a projection that, at a predetermined position, displaces the arm and disengages the projection on the arm from the notch in the carriage.

The toy vehicle of the invention has a retractable stunt wheel that can be adjusted to perform any of a plurality of stunts and an adjustble activating means that allows the user to select at what distance from the start the stunt wheel is engaged. The versatility of the toy and the control of the user over the action of the toy contribute to the pleasure of the user and to his interest in the toy.

Other features and advantages of the invention will be apparent from the description of the Preferred Embodiments, from the Figures, and from the claims.

BRIEF DESCRIPTION OF THE DRAWINGS

FIGS. 3, 4 and 5 are cross-sectional plan views of the toy vehicle of the invention, showing the elements in modified operating relationships;

DESCRIPTION OF THE PREFERRED EMBODIMENT

Figure 11:
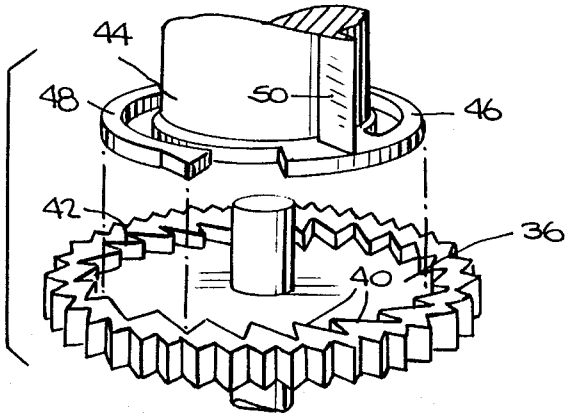
FIG. 11 is an exploded detail view of the distance preselecting apparatus of the toy vehicle of the invention and illustrates the ratchet mechanism employed therein.

Referring to the figures, there is shown a toy car, generally identified by reference number 10, including a chassis 12 and a body 14. Front traveling wheels 16 and 18 are fixedly connected to front axle 20, which in turn is freely rotatable on chassis 12. Rear traveling wheels 22 and 24 are fixedly connected to rear axle 26, which is freely rotatable on chassis 12. Referring now to FIG. 3 and to FIG. 6, worm gear 28 is coaxial with and fixedly attached to rear axle 26. Disk gear 30 engages worm gear 28 and rotates freely about gear post 32. Pinion gear 34, fixedly attached to disk gear 30, engages disk gear 36, which sits on gear post 38. As shown in FIG. 11, disk gear 36, in addition to its peripheral teeth, has ratchet teeth 40 along the edge of a recess 42 along its top surface. Element 44 sits in the recess 42 and has arms 46 and 48 that engage ratchet teeth 40. The cooperation of arms 46 and 48 with ratchet teeth 40 allows clockwise rotation of element 44 within disk gear 36, but prevents counterclockwise rotation. Element 44 is provided with flange 50 fixedly attached thereto and with an arrow indicator 52 on its top surface.

Figure 1:
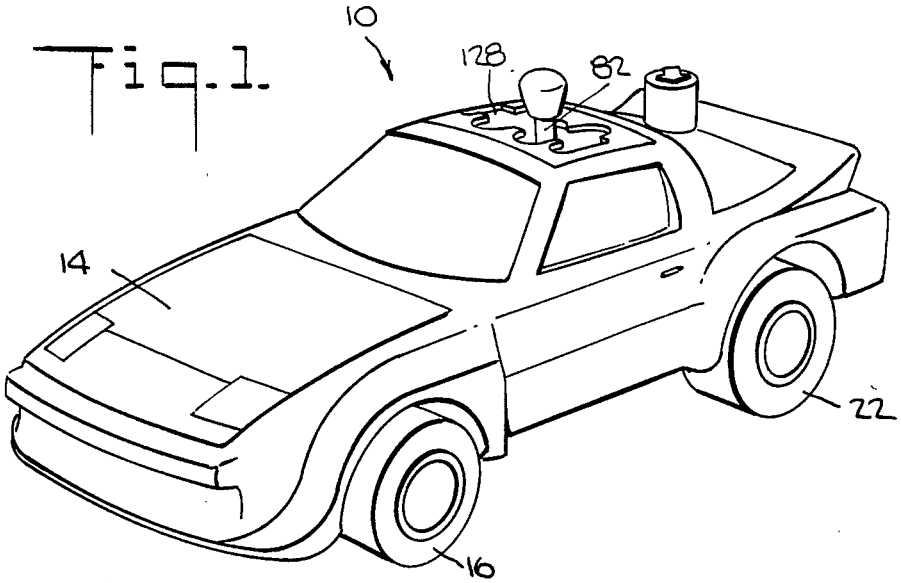
FIG. 1 is a perspective view of the toy vehicle of the invention.
Figure 2:
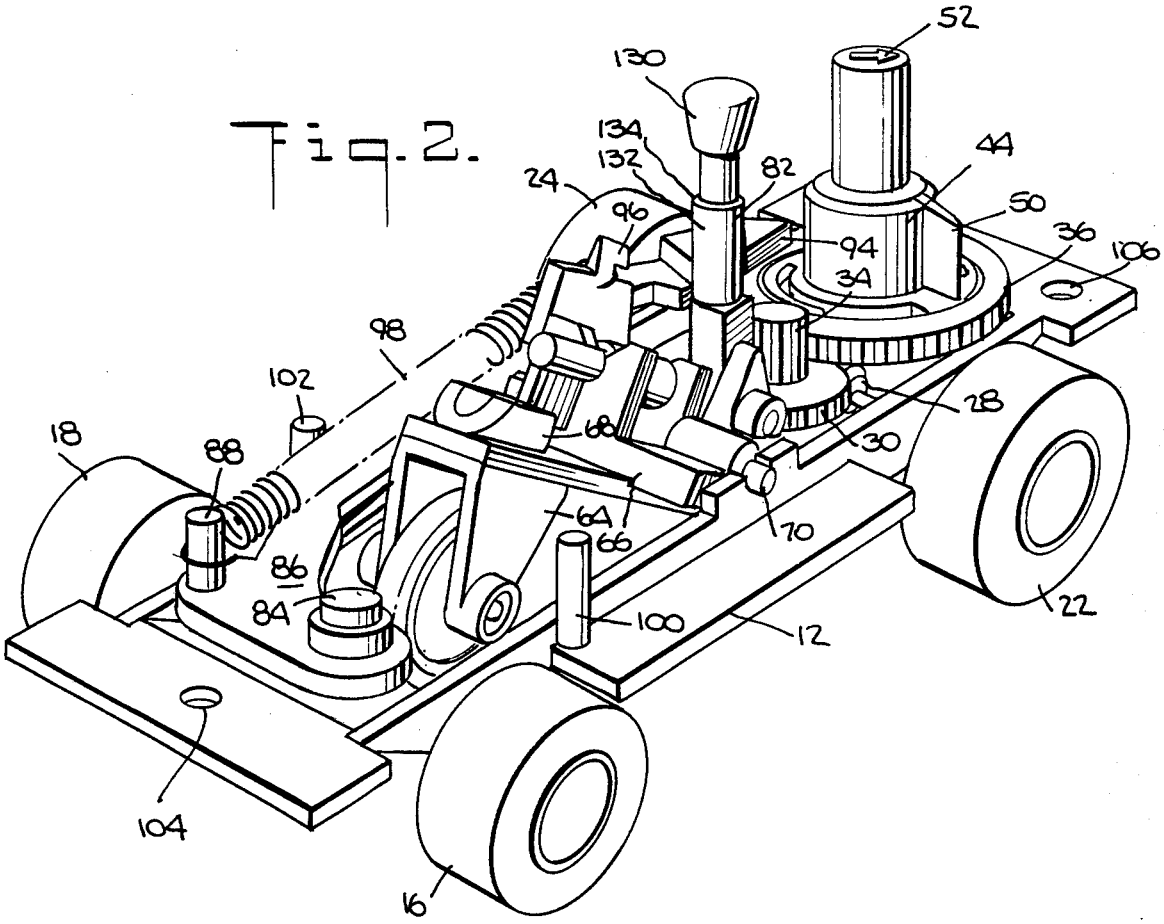
FIG. 2 is a perspective view of the toy vehicle of the invention with the body removed.
Figures 8, 9, 10:
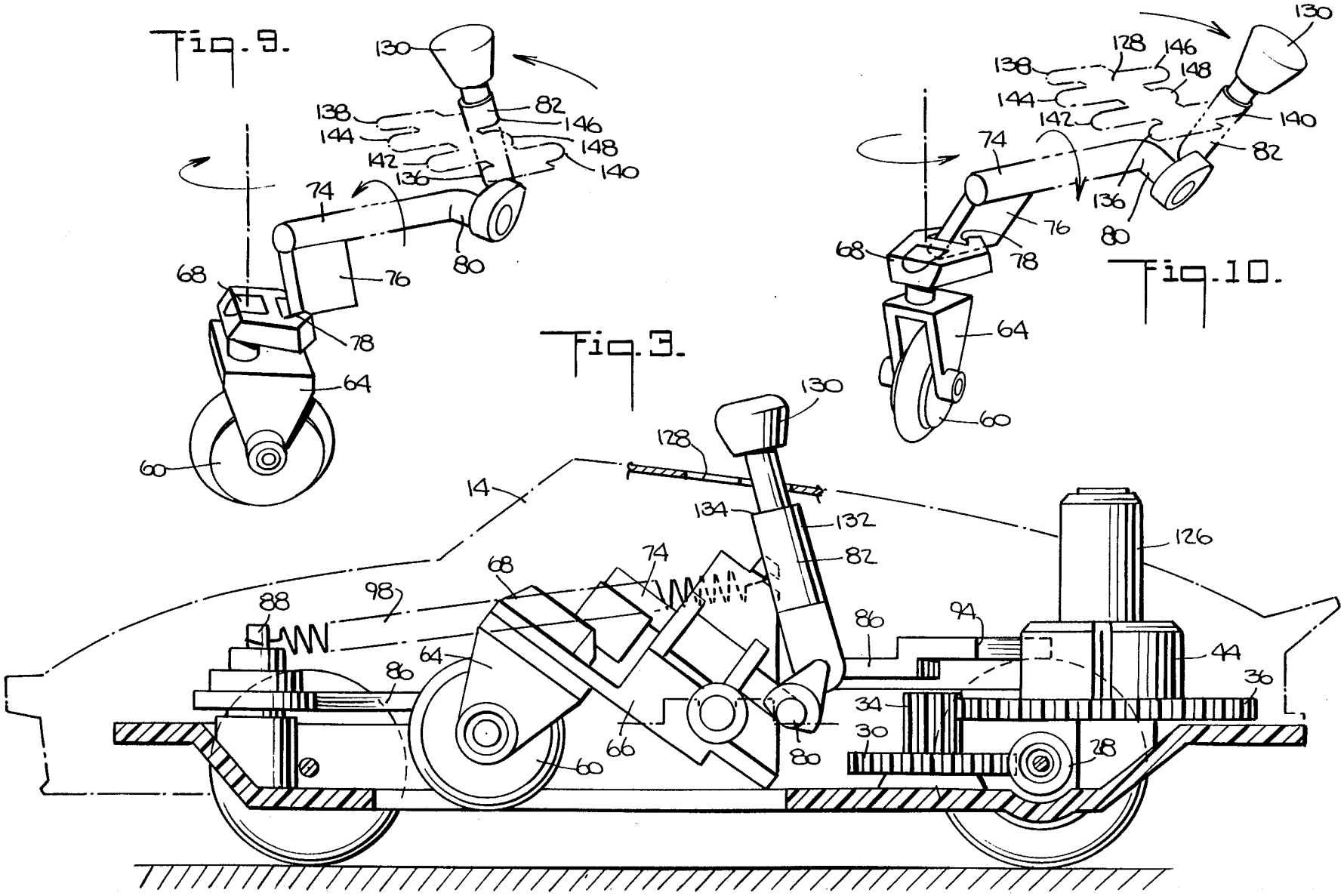
FIG. 8 is an exploded detail view of a portion of the toy vehicle of the invention and illustrates the cooperation between the stunt selecting stick and the stunt wheel.
FIGS. 9 and 10 are detailed views of the essential elements of the stunt selection apparatus of the toy vehicle of the invention and illustrate how manipulation of the stunt selecting stick changes the position of the stunt wheel.

As shown in FIG. 8, stunt wheel 60, disposed within body 14, is journalled at the distal end 62 of bracket 64. The proximal end 65 of bracket 64 is pivotally connected to carriage 66 and fixed thereon by boss 68. Carriage 66 is mounted on chassis 12 with pivot pins 70 and 72, disposed at each of the lateral sides of the carriage. The carriage also houses a side-to-side pivot mechanism. Horizontal member 74 sits on carriage 66 and is axially rotatable on its mounting. The forward end of member 74 has a flange 76 that cooperates with notch 78 in boss 68. The back end of member 74 is provided with a pivot pin 80 on which is disposed stick 82. As shown in FIGS. 9 and 10, side-to-side manipulation of stick 82 causes stunt wheel 60 to turn to the right and left.

Figure 6:
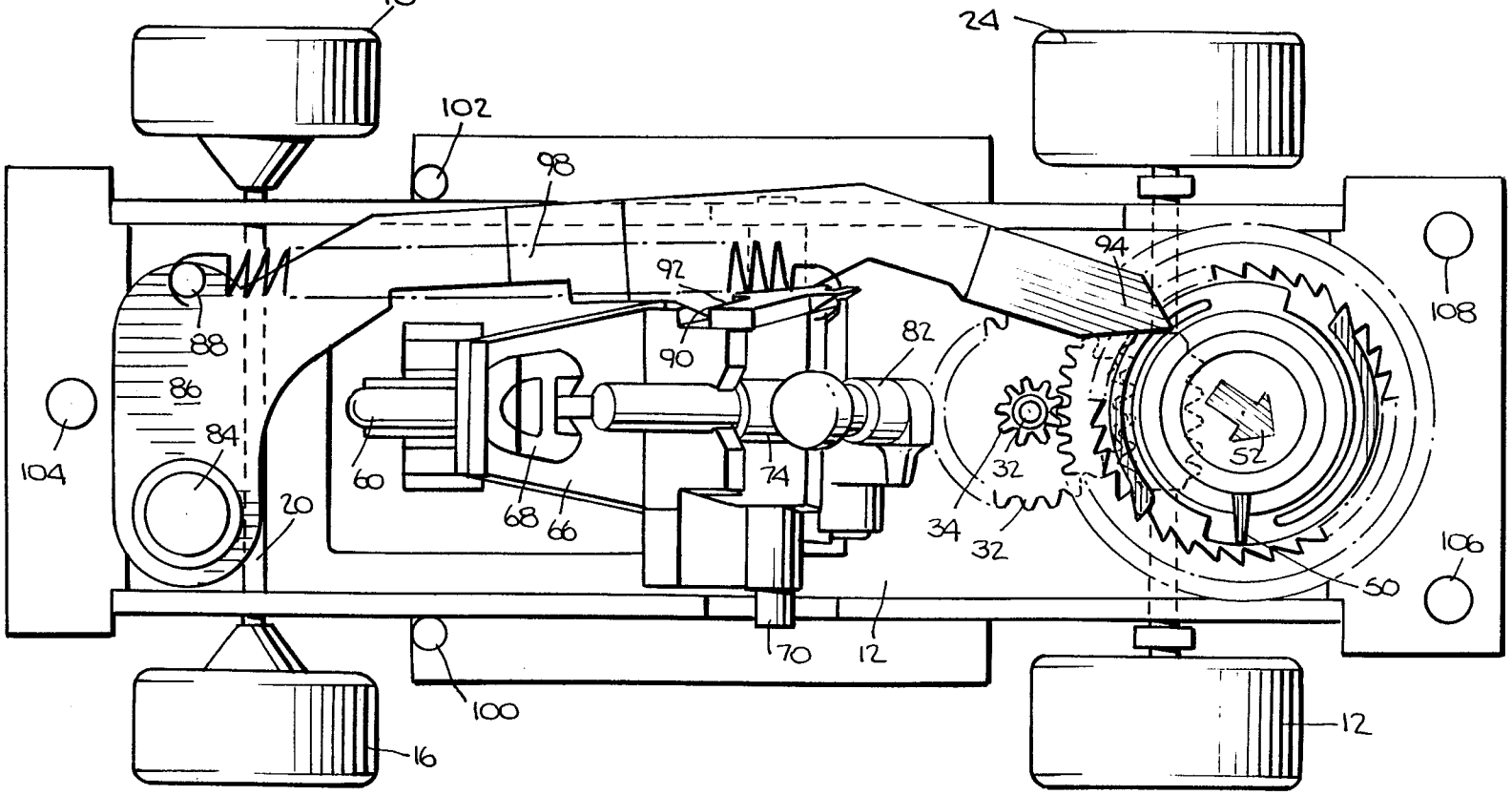
FIGS. 6 and 7 are top plan view of the toy vehicle of the invention with the body removed and showing the elements in modified operating relationships.
Figure 7:
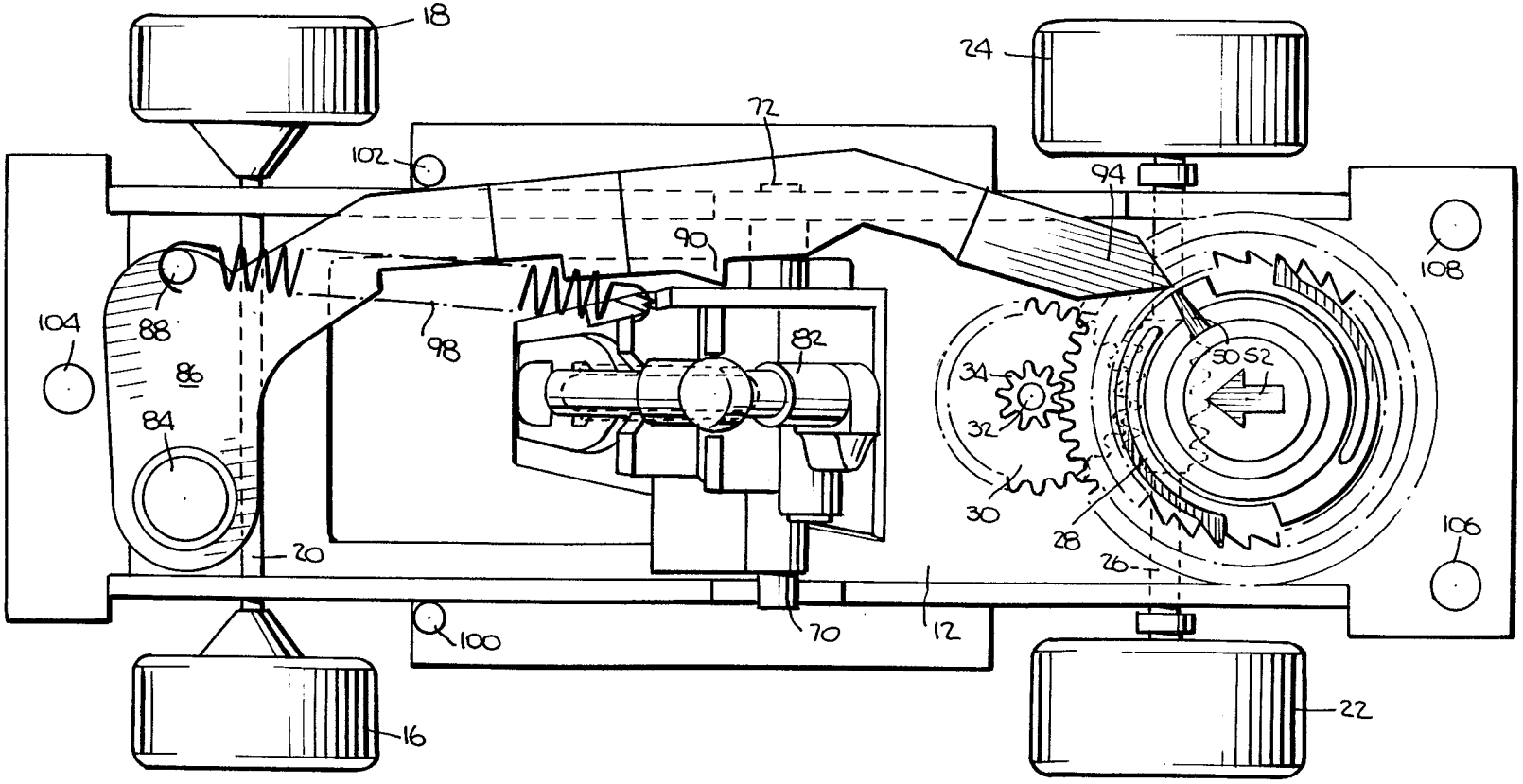
Figure 8:
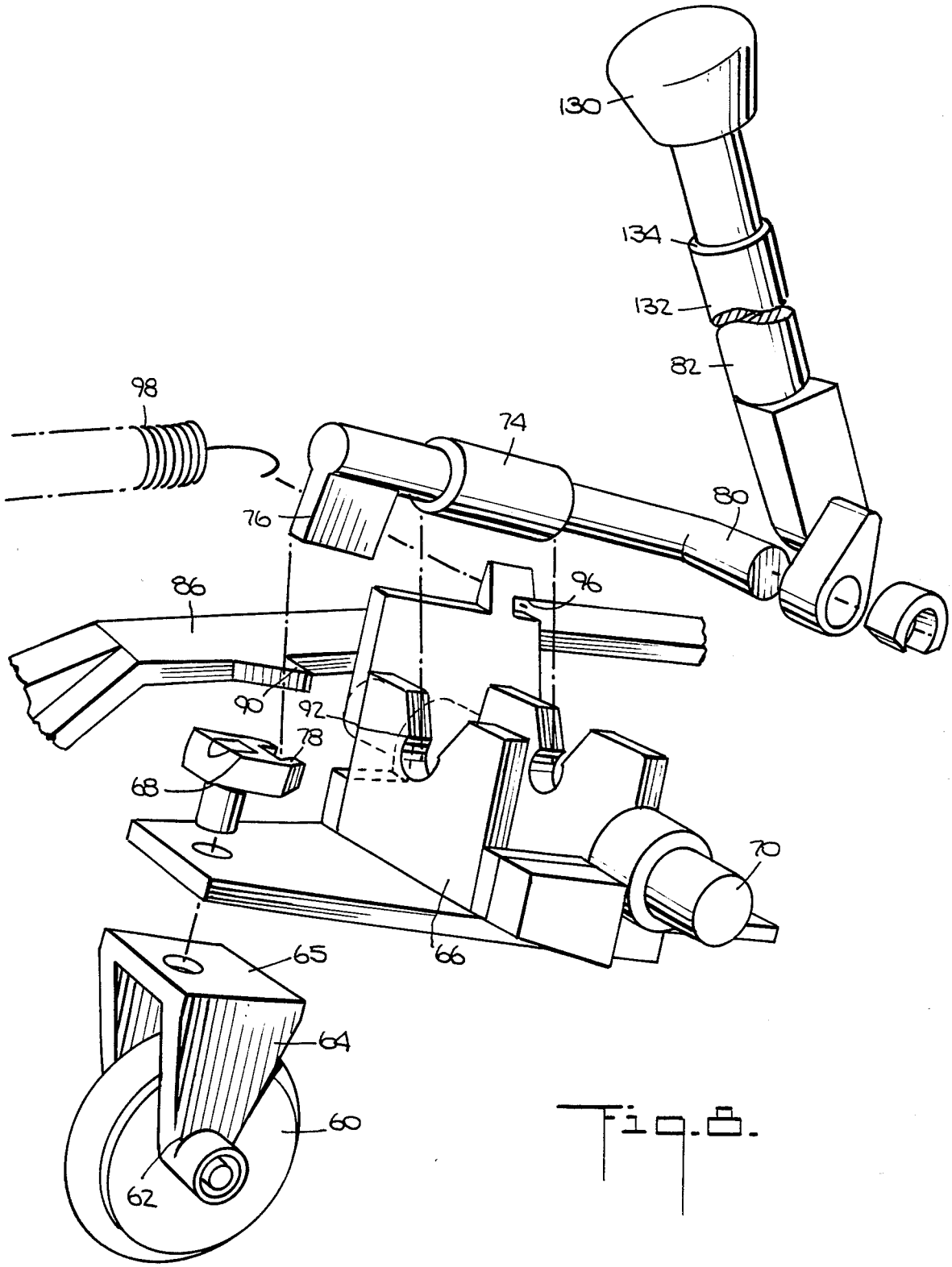

Referring now to FIGS. 6 and 7, the forward end of chassis 12 is provided with pivot pin 84 on which is disposed arm 86. The forward end of arm 86 is provided with a post 88. Protrusion 90 along the length of arm 86 engages notch 92 in carriage 66. When protrusion 90 is in engagement with notch 92, the end 94 of arm 86 is positioned to contact flange 50 if element 44 is oriented appropriately with narrow indicator 52 pointing in the forward direction.

Carriage 66 is further provided with a notch 96, best shown in FIG. 8; tension spring 98 is attached to post 88 and notch 96. Carriage 66 and stunt wheel 60 are maintained in their retracted position when protrusion 90 is in engagement with notch 92. When protrusion 90 is brought out of engagement with notch 92, tension spring 98 pivots carriage 66 forward on pivot pins 70 and 72, bringing stunt wheel 60 into engagement with the playing surface.

Chassis 12 is provided with posts 100 and 102 and with holes 104, 106 and 108 to cooperate, respectively with receiving members and with posts of body 14. Body 14 is additionally provided with a brace to secure pivot pin 70 in its proper position and with a brace to maintain the end 94 of arm 86 in its proper position. An additional receiving member on body 14 secures arm 86 on its pivot pin 84. Body 14 is provided with a hole 126 through which element 44 projects and with a pattern 128 of slots through which stick 82 projects. The stick and the groove pattern are illustrated in FIGS. 9 and 10.

Stick 82 includes a head 130 and a shaft 132. Along shaft 132 is a shoulder 134. The portion of the shaft distal to the shoulder is of a smaller diameter than the portion of the shaft proximal to the shoulder. Slots 136 and 138 are wide enough only to allow the smaller distal portion of the shaft to fit within them. Slots 140, 142, 144, and 146 are wide enough to allow the thick distal portion of the shaft to fit within them.

In operation, the user first adjusts element 44 by turning it in a clockwise direction. Flange 50 engages end 94 of arm 86, causing stunt wheel 60 to engage playing surface when narrow indicator 52 points in the forward direction. Forward motion of the car causes element 44 to rotate in a clockwise direction. Thus, adjustment of element 44 determines at what distance from the starting point the stunt wheel will be engaged. If the arrow indicator is set at 6 o'clock, for example, the car will travel approximately three times as far before engaging the stunt wheel than if the arrow indicator is set at 10 o'clock. FIG. 6 shows the mechanism of the car with the stunt wheel retracted and with the arrow indicator set at about 7 o'clock. FIG. 7 shows the arrow indicator at 12 o'clock, flange 50 engaged with end 94 of arm 86, and the stunt wheel depressed.

Figure 4:
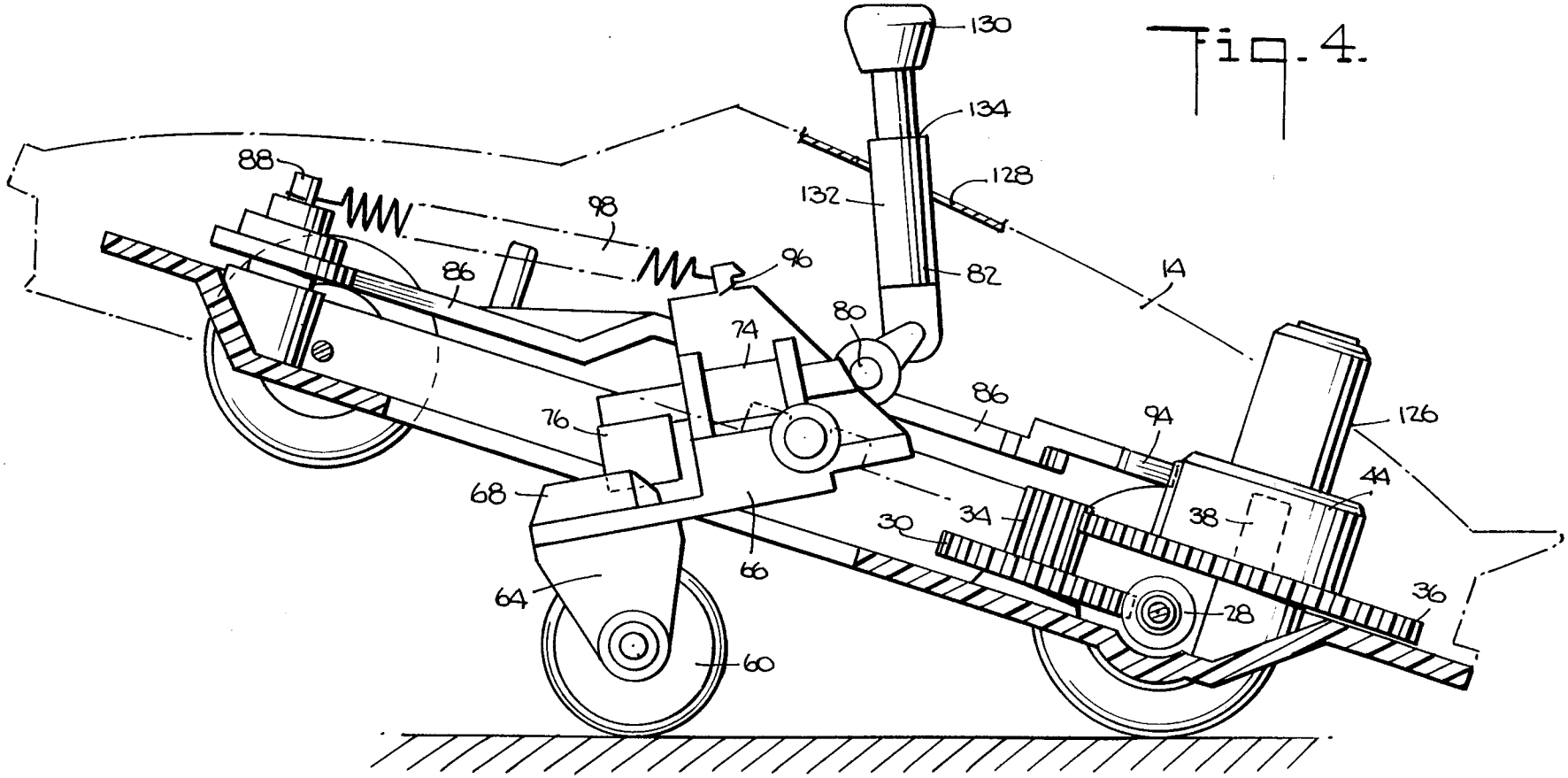
Figure 5:
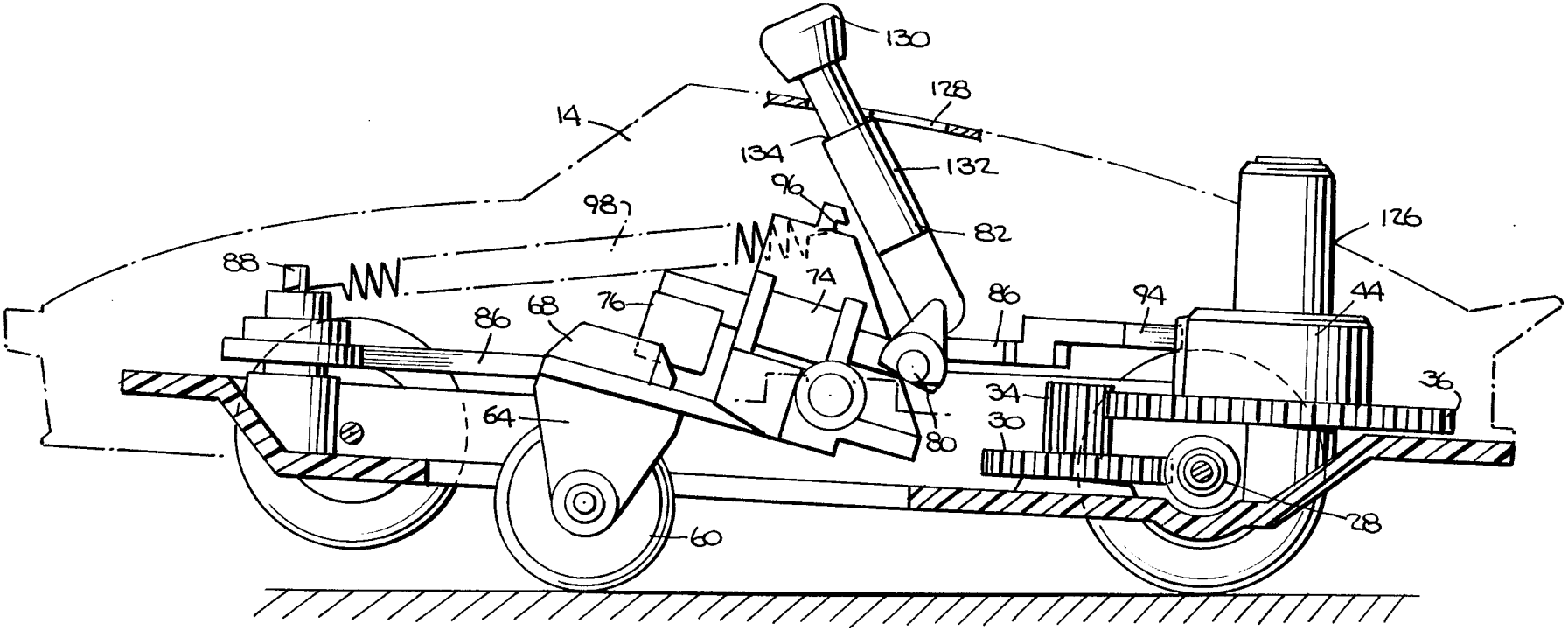

The user then positions stick 82 into one of the slots provided in the body 12. If stick 82 is positioned in slot 136 or 138, the depression of stunt wheel 60 when it is engaged is limited by shoulder 134 on shaft 132 of the stick, and the car performs a left or right turn, respectively, without the front end of the car being elevated appreciably from the playing surface. If stick 82 is positioned in slot 140, 142, 144 or 146, or in central notch 148, then the depression of the stunt wheel when it is engaged is not limited by shoulder 134, and the stunt wheel will be depressed the full distance allowed by the rotation of carriage 66 on its pivot pins 70 and 72. If the stick is placed in slot 140, the car will perform a left spin-out upon engagement of the stunt wheel. With the stick in slot 142, the car will perform a left wheelie. With the stick in slot 144 the car will perform a right wheelie. With the stick in slot 146, the car will perform a right spin-out. If the stick is positioned in central notch 148, the car will perform a wheelie while continuing to travel in the forward direction. FIG. 3 shows the stunt wheel in its retracted position. FIG. 4 shows the stunt wheel fully depressed, as it would appear after activation with stick 82 positioned in any of slots 140, 142, 144, or 146, or in notch 148. FIG. 5 shows the limited depression of the stunt wheel that would result, upon activation, when the stick is positioned in either of the two narrow slots 136 or 138.

After use, the stunt wheel can simply be pushed back into the body of the car. The force of spring 98 biases arm 86 inward so that protrusion 90 will engage notch 92 when the stunt wheel and carriage are retracted into the body. The car can then be reset to perform another stunt selected by the user.

OTHER EMBODIMENTS

Other embodiments are within the following claims. For example: using methods known in the art the car can be provided with an electric motor so that it can travel under its own power; alternatively, again using methods known in the art, the car can be provided with a wheel that stores kinetic energy; or, it can be drawn backward and then will propel itself forward. Vehicles having one or more traveling wheels are within the scope of the invention.

We claim:

1. A toy vehicle, comprising:

a chassis;

a traveling wheel, rotatably mounted on said chassis, supporting said vehicle;

a stunt wheel, supported by said chassis, depressible to contact a running surface and elevate said vehicle; and means, supported by said chassis, for selecting a distance from a predetermined range, and for continuously depressing said stunt wheel in contact with said running surface, elevating said vehicle, after said vehicle has traveled said distance.

2. A toy vehicle as in claim 1 further comprising means for preselecting, from a plurality of choices, an extent to which said stunt wheel is depressed relative to said chassis.

3. A toy vehicle as in claim 2 further comprising means for preselecting an angle of said stunt wheel, during depression, relative to said traveling wheel, and for fixing said stunt wheel at said angle.

4. A toy vehicle as in claim 3, wherein said selecting and depressing means comprises:

means, supported by said chassis, for, upon activation, lowering said stunt wheel; and means, responsively coupled to said traveling wheel, for activating said lowering means after a rotation of said traveling wheel preselected from a predetermined range.

5. A toy vehicle as in claim 4 wherein said angle preselecting means comprises:

a surface, supported by said chassis, having an opening therein comprising a plurality of slots; and a shaft, having a first end, and a second end pivotally coupled to said stunt wheel so that predetermined movement of said first end of said shaft engenders angular movement of said stunt wheel, said first end of said shaft projecting through said opening of said surface and positionable in said slots, said slots corresponding to predetermined angles of said stunt wheel.

6. A toy vehicle as in claim 5, wherein:

depression of said stunt wheel engenders proportional extension of said shaft through said opening in said surface; and said means for preselecting an extent to which said stunt wheel is depressed relative to said chassis comprises a shoulder disposed between said first and second ends of said shaft, and at least one of said slots is configured to preclude passage of said shoulder therethrough upon extension of said shaft.

7. A toy vehicle as in claim 6, wherein said lowering means comprises:

a carriage, pivotally mounted on said chassis, coupled to said stunt wheel, and having a notch therein;

an arm, having a projection thereon aligned to engage said notch in said carriage, a first end pivotally mounted on said chassis, and a second end; and a spring, coupled between said carriage and said arm, urging said carriage downward and said arm against said carriage, engagement of said projection on said arm with said notch in said carriage preventing downward motion of said carriage urged by said spring, and urging of said arm against said carriage by said spring securing said engagement.

8. A toy vehicle as in claim 7, wherein said activating means comprises:

a member, coupled to said traveling wheel, rotating in a first direction in response to rotation of said traveling wheel corresponding to forward motion of said vehicle, rotating in a direction opposite said first direction in response to rotation of said traveling wheel corresponding to backward motion of said vehicle, and having a projection thereon disposed so that upon rotation of said member in said first direction to a predetermined position said projection displaces said second end of said arm, disengaging said projection on said arm from said notch in said carriage, said member being rotatable independently of said traveling wheel only in said first direction, for selectively positioning said projection thereon.

9. A toy vehicle as in claim 1, further comprising means for preselecting an angle of said stunt wheel, during depression, relative to said traveling wheel, and for fixing said stunt wheel at said angle.

10. A toy vehicle as in claim 9, wherein said angle preselecting means comprises:

a surface, supported by said chassis, having an opening therein comprising a plurality of slots; and a shaft, having a first end, and a second end pivotally coupled to said stunt wheel so that predetermined movement of said first end of said shaft engenders angular movement of said stunt wheel, said first end of said shaft projecting through said opening of said surface and positionable in said slots, said slots corresponding to predetermined angles of said stunt wheel.

11. A toy vehicle as in claim 10, wherein said selecting and depressing means comprises:

means, supported by said chassis, for, upon activation, lowering said stunt wheel; and means, responsively coupled to said traveling wheel, for activating said lowering means after a rotation of said traveling wheel preselected from a predetermined range.

12. A toy vehicle as in claim 11, wherein said lowering means comprises:

a carriage, pivotally mounted on said chassis, coupled to said stunt wheel, and having a notch therein;

an arm, having a projection thereon aligned to engage said notch in said carriage, a first end pivotally mounted on said chassis, and a second end; and a spring, coupled between said carriage and said arm, urging said carriage downward and said arm against said carriage, engagement of said projection on said arm with said notch in said carriage preventing downward motion of said carriage urged by said spring, and urging of said arm against said carriage by said spring securing said engagement.

13. A toy vehicle as in claim 12, wherein said activating means comprises:

a member, coupled to said traveling wheel, rotating in a first direction in response to rotation of said traveling wheel corresponding to forward motion of said vehicle, rotating in a direction opposite said first direction in response to rotation of said traveling wheel corresponding to backward motion of said vehicle, and having a projection thereon disposed so that upon rotation of said member in said first direction to a predetermined position said projection displaces said second end of said arm, disengaging said projection on said arm from said notch in said carriage, said member being rotatable independently of said traveling wheel only in said first direction, for selectively positioning said projection thereon.

14. A toy vehicle as in claim 1, wherein said selecting and depressing means comprises:

means, supported by said chassis, for, upon activation, lowering said stunt wheel; and means, responsively coupled to said traveling wheel, for activating said lowering means after a rotation of said traveling wheel preselected from a predetermined range.

15. A toy vehicle as in claim 14, wherein said lowering means comprises:

a carriage, pivotally mounted on said chassis, coupled to said stunt wheel, and having a notch therein;

an arm, having a projection thereon aligned to engage said notch in said carriage, a first end pivotally mounted on said chassis, and a second end; and a spring, coupled between said carriage and said arm, urging said carriage downward and said arm against said carriage, engagement of said projection on said arm with said notch in said carriage preventing downward motion of said carriage urged by said spring, and urging of said arm against said carriage by said spring securing said engagement.

16. A toy vehicle as in claim 15, wherein said activating means comprises:

a member, coupled to said traveling wheel, rotating in a first direction in response to rotation of said traveling wheel corresponding to forward motion of said vehicle, rotating in a direction opposite said first direction in response to rotation of said traveling wheel corresponding to backward motion of said vehicle, and having a projection thereon disposed so that upon rotation of said member in said first direction to a predetermined position said projection displaces said second end of said arm from said notch in said carriage, said member being rotatable independently of said traveling wheel only in said first direction, for selectively positioning said projection thereon.

* * * * *